US009057216B2

(12) United States Patent
Bortoluzzi et al.

(10) Patent No.: US 9,057,216 B2
(45) Date of Patent: Jun. 16, 2015

(54) DEVICE FOR APPLYING LATERALLY RETRACTING DOORS, PARTICULARLY FOR PIECES OF FURNITURE

(75) Inventors: Guido Bortoluzzi, Belluno (IT); Adriano Girotto, Villorba (IT)

(73) Assignee: BORTOLUZZI LAB S.R.L., Belluno (IT)

( * ) Notice: Subject to any disclaimer, the term of this patent is extended or adjusted under 35 U.S.C. 154(b) by 95 days.

(21) Appl. No.: 13/884,400

(22) PCT Filed: Dec. 1, 2011

(86) PCT No.: PCT/EP2011/071512

§ 371 (c)(1),
(2), (4) Date: May 9, 2013

(87) PCT Pub. No.: WO2012/072738

PCT Pub. Date: Jun. 7, 2012

(65) Prior Publication Data

US 2013/0232878 A1 Sep. 12, 2013

(30) Foreign Application Priority Data

Dec. 3, 2010 (IT) ..... BL2010A0020

(51) Int. Cl.

| | |
|---|---|
| ***A47B 88/00*** | (2006.01) |
| ***E05D 15/00*** | (2006.01) |
| ***E05D 3/06*** | (2006.01) |

(Continued)

(52) U.S. Cl.

CPC ..... *E05D 15/52* (2013.01); *E05D 15/58* (2013.01); *E05Y 2201/626* (2013.01); *E05Y 2900/14* (2013.01); *E05Y 2900/20* (2013.01)

(58) Field of Classification Search

CPC ..... E06B 3/5045; E05Y 2900/212; Y10T 16/367

USPC ..... 312/322, 297, 326, 319.1, 110, 323; 49/360, 254, 257, 272, 405; 16/92, 366

See application file for complete search history.

(56) References Cited

U.S. PATENT DOCUMENTS 245,605 A * 8/1881 Brinton ..... 16/92
352,906 A * 11/1886 Allan ..... 16/92

(Continued)

FOREIGN PATENT DOCUMENTS

CN 101166448 A 4/2008
CN 101438022 A 5/2009

(Continued)

OTHER PUBLICATIONS

Chinese Examination Report dated Jan. 28, 2015.

*Primary Examiner* — Daniel J Troy
*Assistant Examiner* — Kimberley S Wright
(74) *Attorney, Agent, or Firm* — Lando & Anastasi, LLP

(57) ABSTRACT

A device to be applied at least between a side wall of the internal space of a piece of furniture and an adjacent door thereof, in order to render it laterally retracting during the opening of the internal space, comprising a pivoting upright interposed along the side of the door that is to be rendered laterally retracting of a piece of furniture, and provided with longitudinal guides for the vertical sliding of one of the two ends of a pair of rockers, each rocker being able to oscillate on a respective pivot, which is integrally pivoted to the same shoulder of a compartment, and is formed by a pair of arms which converge and are mutually integral.

17 Claims, 12 Drawing Sheets

(51) Int. Cl.

| | |
|---|---|
| ***E05D 15/52*** | (2006.01) |
| ***E05D 15/58*** | (2006.01) |

(56) References Cited

U.S. PATENT DOCUMENTS

| | | | | | |
|---|---|---|---|---|---|
| 374,859 | A | * | 12/1887 | Wilson | 16/92 |
| 423,280 | A | * | 3/1890 | Schlutter | 16/92 |
| 511,208 | A | * | 12/1893 | Nilson | 16/92 |
| 863,286 | A | * | 8/1907 | Kershaw | 312/110 |
| 899,049 | A | * | 9/1908 | Honor | 312/110 |
| 972,412 | A | * | 10/1910 | Taussig | 49/257 |
| 984,793 | A | * | 2/1911 | Blomberg | 312/110 |
| 1,348,680 | A | * | 8/1920 | Woltz | 312/110 |
| 1,513,849 | A | * | 11/1924 | Moore | 109/70 |
| 1,720,050 | A | * | 7/1929 | Morris et al. | 312/110 |
| 1,909,849 | A | * | 5/1933 | Shulte | 109/70 |
| 1,930,547 | A | * | 10/1933 | Bales et al. | 312/110 |
| 1,933,904 | A | * | 11/1933 | Hawks | 160/118 |
| 2,632,926 | A | * | 3/1953 | Haley | 49/405 |
| 2,709,029 | A | * | 5/1955 | Cox | 53/244 |
| 2,774,644 | A | * | 12/1956 | Patterson | 312/331 |
| 3,359,684 | A | * | 12/1967 | Tinder | 49/349 |
| 3,456,995 | A | * | 7/1969 | Nyquist | 312/322 |
| 3,570,579 | A | * | 3/1971 | Matsushima | 160/235 |
| 3,724,133 | A | * | 4/1973 | Shirai et al. | 49/349 |
| 3,880,094 | A | * | 4/1975 | Kopp et al. | 108/74 |
| 4,655,144 | A | * | 4/1987 | Frech et al. | 105/341 |
| 4,729,612 | A | * | 3/1988 | Stone | 312/109 |
| 4,729,615 | A | * | 3/1988 | Ishizawa et al. | 312/324 |
| 4,815,797 | A | * | 3/1989 | Haab et al. | 312/322 |
| 4,821,375 | A | * | 4/1989 | Kozon | 16/360 |
| 4,852,212 | A | * | 8/1989 | Amann | 16/102 |
| 4,974,912 | A | * | 12/1990 | Rask et al. | 312/110 |
| 4,976,502 | A | * | 12/1990 | Kelley et al. | 312/322 |
| 5,078,461 | A | * | 1/1992 | Beck et al. | 312/331 |
| 5,121,976 | A | * | 6/1992 | Haab et al. | 312/322 |
| 5,149,180 | A | * | 9/1992 | Haab et al. | 312/322 |
| 5,520,451 | A | * | 5/1996 | Oshima | 312/322 |
| 6,332,660 | B1 | * | 12/2001 | Salice | 312/328 |
| 6,994,410 | B2 | * | 2/2006 | Hogan | 312/322 |
| 8,104,850 | B2 | * | 1/2012 | Hager et al. | 312/245 |
| 8,950,115 | B2 | * | 2/2015 | Andersson et al. | 49/212 |
| 2008/0218043 | A1 | * | 9/2008 | Gianelo | 312/319.2 |
| 2010/0117500 | A1 | * | 5/2010 | Giorgi | 312/319.1 |
| 2010/0270898 | A1 | * | 10/2010 | Haab et al. | 312/323 |

FOREIGN PATENT DOCUMENTS

| | | | |
|---|---|---|---|
| CN | 101876229 | A | 11/2010 |
| DE | 4308196 | A1 | 10/1993 |
| DE | 19902918 | A1 | 8/1999 |
| WO | 2007148366 | A1 | 12/2007 |

* cited by examiner

DEVICE FOR APPLYING LATERALLY RETRACTING DOORS, PARTICULARLY FOR PIECES OF FURNITURE

The present invention relates to a new device to be applied at least between a side wall of the internal space of a piece of furniture and an adjacent door thereof, in order to make it of the laterally retracting type, during the opening of the internal space.

The main characteristic of the present invention is to provide for the interposition of a hinge upright along the side of the door that one wishes to render laterally retractable of a piece of furniture, the upright being rendered able to slide in depth, along the outer surface of the shoulder of the internal space of the piece of furniture, and being provided with longitudinal guides, which are integral with the shoulder, for the vertical sliding of one of the two ends of a pair of rockers, each rocker being rendered able to oscillate on a respective pivot, which is hinged integrally with the same shoulder of the internal space and is formed by a pair of arms which converge and are mutually integral; the arm of such arms that is not slidingly engaged with the vertical upright is instead connected to the corresponding arm of the other rocker, by means of a load distribution bar, which is adapted to uniform and discharge the weight of the door onto its upright, with respect to the changeable moment of imbalance in each step of sliding and holding, within the retraction compartment.

BACKGROUND OF THE INVENTION

With respect to ordinary swing-doors, retractable doors have the advantage of minimizing their space occupation, particularly during opening and closing, when swing-doors must rotate about their hinges, with a wide radius of motion of the door, within a surface that accordingly cannot be rendered useful. This situation affects the opening, the closure and the positioning of doors for walls, as well as the opening, closure and positioning of doors or door wings for pieces of furniture, with consequent problems in terms of space, particularly in apartments, in offices or in any case in small enclosed spaces.

According to a predominant method, such retractable doors, particularly for masonry, have an upper edge which is provided with a pair of brackets with corresponding rollers, which are rendered able to slide on a guide which also continues along a blind compartment which is provided in the wall, on the side where one wishes to push the retractable door. A more solid and complete form or structure of this traditional method is disclosed for example in EP0417000.

In the specific sector of furniture, the retraction of a sliding door wing corresponds normally to its full or partial arrangement behind an adjacent visible door wing, both wings being provided with respective guides or tracks for support and translation and the piece of furniture generally not having a blind and fixed front wall, behind which the wing of the compartment to be opened is pushed so as to be concealed.

In any case, again in the furniture sector, solutions have been proposed which tend to translate the sliding door wing for opening, until it is in a position that is parallel to the side wall of the piece of furniture. One of the first known solutions of this type is constituted by FR 2.690.195. According to the teaching of this patent, a sliding door of a piece of furniture is provided in two vertical elements, both of which are engaged in two front guides, an upper one and a lower one, of the piece of furniture, and are pivoted to an intermediate shoulder, which is not coupled to the guides, and can close by pivoting along one edge onto the shoulder, during the opening of the internal space, in order to be guided and accommodated in a compartment which is lateral with respect to the useful internal space of the piece of furniture.

This solution has indeed solved the problem of eliminating the space occupation of the door when the internal space of the piece of furniture must be opened and must remain open, ensuring minimal space occupation even during the opening and closure of the door. However, the difficulty of supporting the door in a manner that is vertically stable over time, due to its weight which acts on the front and depth guides of the piece of furniture, as well as the delicate nature of the device for rotation at right angles of the door, in order to enter and exit from its retraction compartment, have led to limited use of this solution.

Another known solution is constituted by the teaching of DE 19902918, according to which the sliding door wing is associated laterally and pivoted to an upright which can perform a translational motion in depth on the side or side element of the piece of furniture, the upright being supported by the ends of two bars that are arranged in a pantograph-like arrangement, in which one end can slide along a guide respectively of the upright and of the bottom of the piece of furniture, and being accommodated in the same compartment that accommodates the retracting door.

Even this solution, despite contributing to solve the problem of the space occupation of the door of a piece of furniture, has encountered limited application, mainly because a substantial extent of the compartment is designed to accommodate the supporting pantograph, even in the case of a door in the retracted condition, with the consequent need to be able to provide doors that only have a small aperture or to provide double-wing doors which are mutually hinged along one edge. In this second case, in addition to the less than exciting aesthetic appearance, there is also a considerable cantilever load that acts on the crosspiece, with a rapid deterioration of its supporting guides. However, the greatest drawback of this solution is constituted by the fact that when the crosspiece is in the closed position, therefore with the door in the retracted condition, its supporting capacity is at its minimum, with a heavy imbalance and misalignment of the doors even during the closure of the piece of furniture.

A more recent solution has been disclosed in WO2007/148366, according to which the sliding door of a piece of furniture is constituted by a door with a first door wing which is articulated to a second door wing, which is mounted so that it can slide within the retraction compartment, and is characterized in that the first door wing is guided by guiding elements which are arranged on the upper and lower edge and can slide on an upper and lower guide that lies parallel to the front edge and to the inside of the retraction compartment, and in that the supporting element comprises elastic means which can be subjected to torsion during the closure of the door, transmitting to the supporting element a force which is sufficient to cause a retraction motion of the door wings into the folded position within the retraction compartment.

Even this solution, despite improving the operating conditions of the above cited FR 2690195, is in any case limited by the presence of a door that is provided in three elements and therefore has a poor aesthetic impact. Moreover, this solution entails a considerable constructive complexity, which affects considerably the times and costs of the production and maintenance of cabinets or pieces of furniture of this type.

These and other similar known solutions, furthermore, often do not provide for the possibility of damping the end of the stroke, during the insertion and extraction of the wing from the lateral compartment, in addition to generally providing for a closed condition of the wing that does not cover the uprights of the piece of furniture and therefore has a negative effect on the utilization of its useful internal space.

SUMMARY OF THE INVENTION

The aim of the present invention is to be able to provide a device that allows the application of laterally retracting doors, even of good size and weight, in addition to being provided in a single panel, even without the need to hinge and fold two or more elements of a same wing.

Within this aim, an object of the invention is to provide a device for the application of laterally retracting doors or door wings that can be balanced easily and therefore is extremely lightweight and quiet during translation as well as assuredly durable over time.

A further object of the present invention is to provide a device for the application of laterally retracting doors or door wings that also allows damping of the opening or closing motion, thus also consolidating even the best operating conditions and durability conditions of the piece of furniture.

Another object of the present invention is to provide a device for the application of laterally retracting doors or door wings that are capable of covering also the lateral edges or uprights of the piece of furniture, gaining also in terms of volume on its useful internal space, in addition to giving the piece of furniture a higher aesthetic value.

This aim and these and other objects are indeed perfectly achieved with the present invention, which provides for the interposition of a pivoting upright along the side of the door that one wishes to render laterally retractable of a piece of furniture, said upright being rendered able to slide in depth and being associated with a pair of rockers which it is adapted to render able to oscillate according to the content of claim 1.

BRIEF DESCRIPTION OF THE DRAWINGS

A better comprehension of the proposed device and a clarification of the achievement of the specified aim and objects are described and illustrated in greater detail hereinafter according to a purely indicative and non-limiting constructive embodiment thereof, also with the aid of the accompanying drawings and wherein.

DESCRIPTION OF THE PREFERRED EMBODIMENTS

Figure 1:
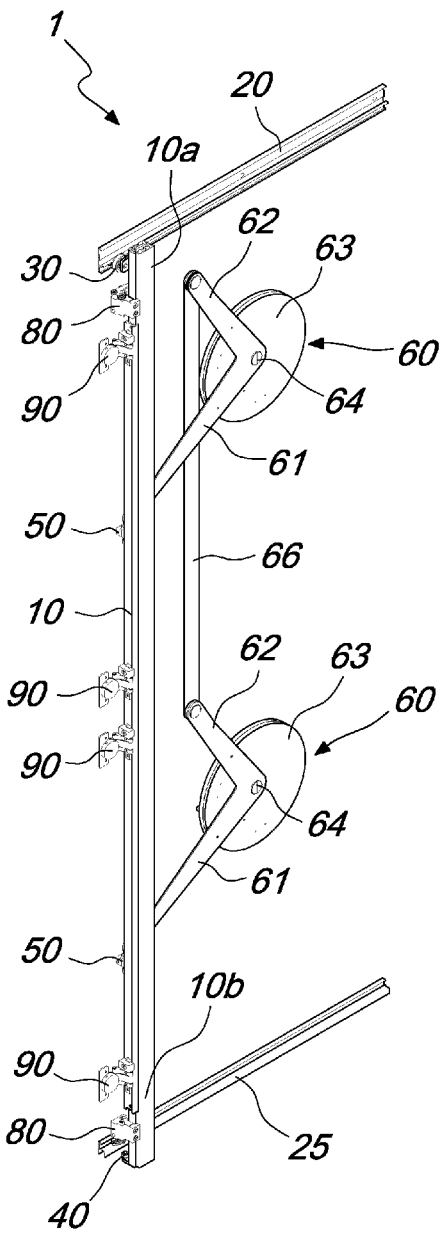
FIG. 1 is a perspective view of the arrangement of the main parts that constitute the device for applying laterally retracting doors for pieces of furniture or wardrobes and the like, according to the present invention.

In all the figures, the same details are represented, or are understood to be represented, with the same reference numeral.

With particular reference to FIGS. 1, 2, 3*a*, 3*b* and 3*c*, one can see that the device 1 being considered is composed of an upright 10 constituted by a profile, in which the upper end 10*a* and the lower end 10*b* are rendered able to slide along the respective profile guides 20 and 25, which are fixed horizontally on the outer surface of the side of the internal space V to which a retractable door A is to be applied. The retractable door A and the device 1 being considered can be advantageously accommodated in a retraction compartment B, which is adjacent to the useful internal space V of the piece of furniture M and is completed by an outside wall, with the ceiling and footing of the same piece of furniture.

In greater detail, the upright or profile 10 has an outer longitudinal groove thereof 11, with a longitudinal cavity that has a semicircular cross-section 12, and an inner longitudinal groove 12*a*, in addition to a lateral shoulder 13 thereof which is T-shaped. The profile 10 is furthermore provided with a wall or longitudinal rib 14 which forms an intermediate compartment 12*b*, which is open toward the semicircular cavity 12 due to the presence of the longitudinal groove 12*a*.

The shoulder 13 of the upright 10 is designed to accommodate the internal compartment 15*a* of a profile 15 which is provided with a length that is slightly shorter than the length of the upright 10 and has double-C shape, having a compartment 15*b* which is arranged opposite the compartment 15*a* and is designed to accommodate the bases of a series of hinges 90, as specified better hereinafter.

The compartment 15*a* of the profile 15 is designed to accommodate the shoulder 13 of the upright 10, after longitudinal sliding, in order to be adjusted and locked axially and transversely thereto, according to one of the methods of the already-known type and indicated by way of example with the fixing seat 16 in FIG. 3.

As already mentioned, the upright 10 is rendered able to slide along the guides 20 and 25 by interposition respectively of an upper carriage 30 and of a lower carriage 40, which are conveniently fixed respectively to its ends 10*a* and 10*b*.

Figure 4:
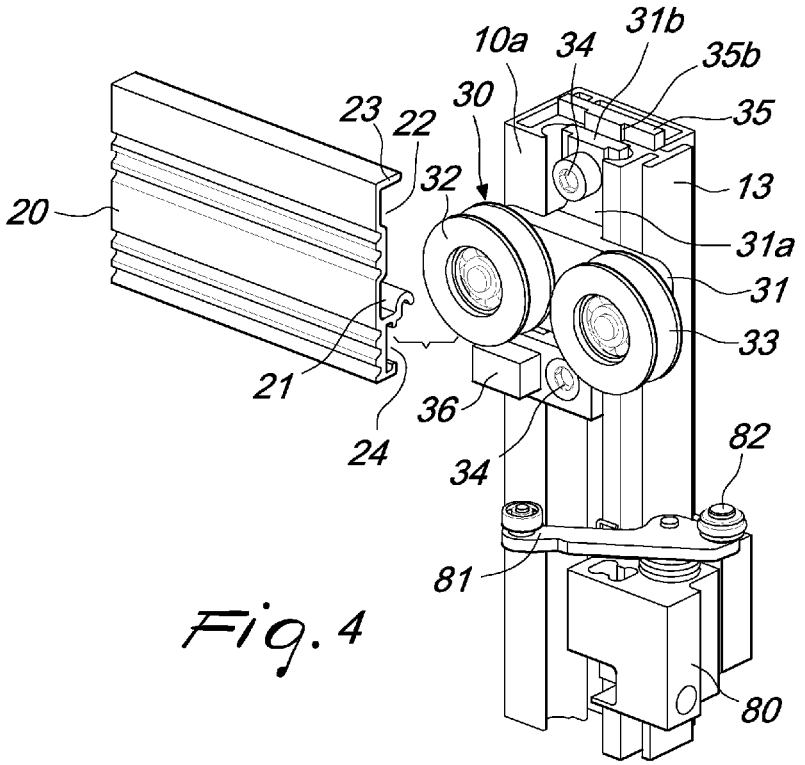
FIG. 4 is a partial enlarged-scale and detailed perspective view of the elements that constitute the upper part of the device of FIGS. 1 and 2.

With reference to FIG. 4, an upper carriage 30 is constituted by a plate 31 for supporting a pair of free pulleys 32-33, the plate 31 being provided with a stem 31*a* with a base plate 31*b* on which a pair of screws 34 is rendered able to pass and is adapted to screw onto the threaded seat of at least one contrast plate 35. Such contrast plate 35 is accommodated in the compartment 12*b* of the end 10*a* of the upright 10 and is provided preferably with shoulders 35*b* which are adapted to be guided within the groove 12*b* of the upright 10. The screwing of the screws 34 therefore allows perfect locking of the carriage 30 in the correct position of the end 10*a* of the upright 10, such position being defined by a head shoulder of the contrast plate 35.

The carriage 30 is naturally applied to the upper guide 20, accommodating the grooves of the pulleys 32-33 along the rail 21, so as to render it able to slide along the compartment 22 of the upper guide 20, which also inhibits its lateral escape in the presence of its perpendicular upper edge 23.

Finally, the upper guide 20 is provided with a lower compartment 24, which allows the passage of the stroke limiting block 36, which is adapted to abut against an adapted abutment 37, in order to delimit the stopping point of the carriage 30 and therefore of the upright 10 and of the door A in the front part of the retraction compartment B.

Figure 5:
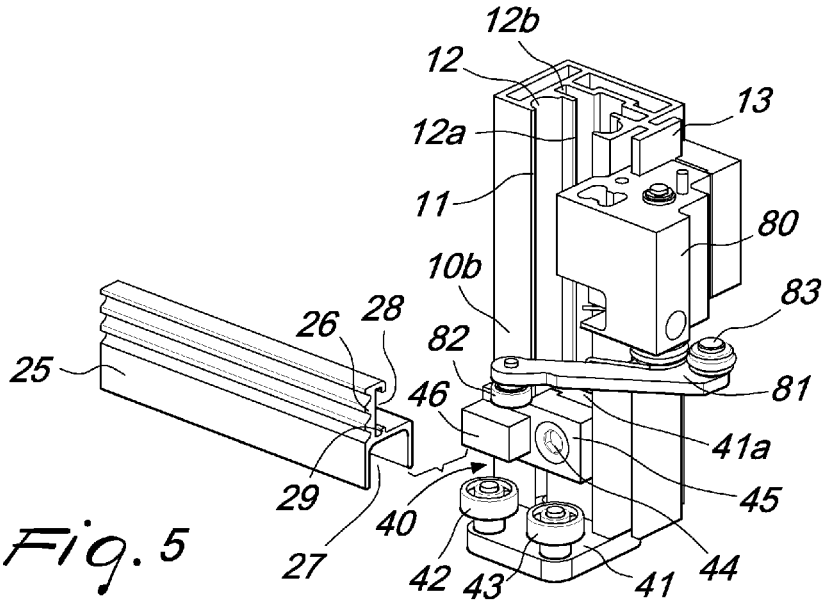
FIG. 5 is a partial enlarged-scale and detailed perspective view of the elements that constitute the lower part of the device of FIGS. 1 and 2.

Proximate to the upper end 10*a* and lower end 10*b*, therefore preferably close to the carriages 30 and 40, the upright 10 is also provided with a pair of devices 80 for preventing the retraction of the door A into the compartment B, which are actuated by the door A itself which acts on the circular rubber pad 83 of the elastic arm 81, to the opposite end of which a roller 82 is applied. During the rotation of the door A, for its swing closure onto the internal space V, the rollers 82 are pushed laterally into a compartment that is provided on the surface of the shoulder of the piece of furniture M, in order to prevent the unwanted retraction of the upright 10 into the retraction compartment B. When the door A is in the initial step of its accommodation in the compartment B, the rubber pad 83 slides along the surface of the door A, rotating the arm 81, until the roller 82 is made to exit from its seat, and the stroke of the door A within the compartment B is released, according to a known method and as exemplified in FIG. 5.

Again with reference to FIG. 5, a lower carriage 40 is constituted by a plate 41 for supporting a pair of free rollers 42-43, the plate 41 being provided with a substantially perpendicular stem 41*a* which is arranged in the compartment 12*b* of the upright 10 and is associated by means of at least one screw 44 with an external contrast plate 45, which is accommodated in the compartment 11 of the upright 10, for the correct locking of the carriage 40 to its end 10*b*.

The lower carriage 40 is naturally applied to the lower guide 25, accommodating its rollers 42-43 along the guiding seat 27, which allows its stroke in depth within the retraction compartment B.

Finally, the lower guide 25 is provided with an upper compartment 28, which allows the passage of the stroke limiting block 46, which is adapted to abut against an abutment 37, in order to delimit the stopping point of the carriage 40, therefore of the upright 10 and of the door A at the rear end of the retraction compartment B. Proximate to the lower end 10*b* a device 80 is provided for preventing the return of the door A into the compartment B, as specified above.

Of course, the positioning and locking of the carriages 30-40 at the ends 10*a*-10*b* of the upright 10 allows a perfectly parallel arrangement in the stroke of the carriages 30-40 along the respective guides 20-25 at any time of its motion or positioning of the door A within the retraction compartment B.

With reference to the various FIGS. 1 to 6, the semi-cylindrical cavity 12 of the upright 10 is designed to accommodate a pair of annular free wheels 52-53 of two carriages 50, which are inserted therein in the intermediate part of the upright 10, before applying and fixing the upper carriages 30 and/or the lower carriage 40 described so far. The intermediate carriages 50 are meant to ensure a dynamic connection of the upright 10, therefore of the door A integrally hinged thereto, with a respective end or arm 61 of a pair of rockers 60 which are described better hereinafter.

Figure 6:
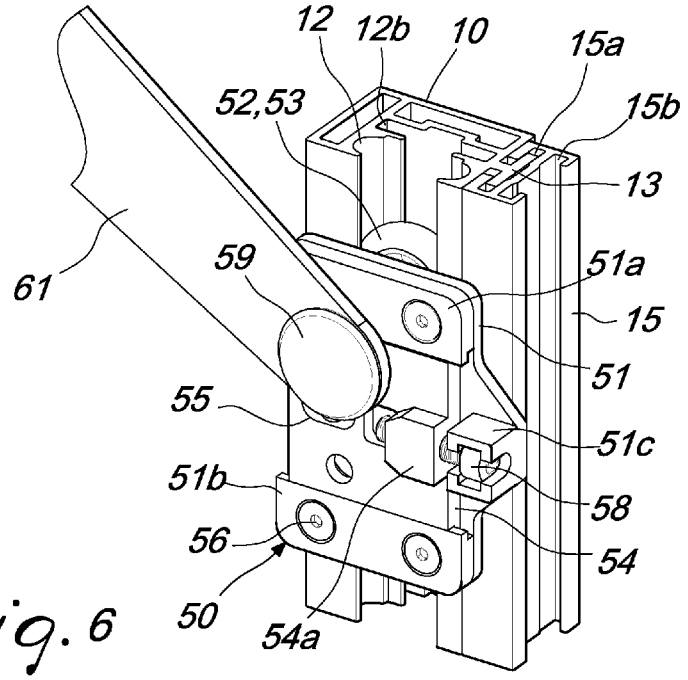
FIG. 6 is a partial enlarged-scale and detailed perspective view of the elements that constitute the central part of the device of FIGS. 1 and 2.

In particular, with reference to FIG. 6, an intermediate carriage 50 is constituted substantially by a plate 51 which, by means of adapted pivots (not shown), is adapted to support the pair of free wheels 52-53, which are accommodated in the semi-cylindrical cavity 12 of the upright 10, while a contrast plate 54 is guided therein and retained by a pair of lateral guides 51*a*-51*b*, which are joined to the base plate 51 for example by means of four screws 56. A pivot 59 is integrally applied to the contrast plate 54 and, through the possible interposition of bearings or bushings, hinges the end of an arm 61 of a rocker 60.

The contrast plate 54 is provided with a nut or threaded protrusion 54*a* into which the stem of a screw 58 is screwed whose head is to accommodated in a compartment 51*c* of the base plate 51.

By turning the screw 58, the contrast plate 54 is forced to perform a translational motion along the guides 51*a*-51*b*, with a consequent transverse movement of the pivot 59 and of the end of the arm 61 of the rocker 60. By acting on the screw 58 of at least one of the carriages 50, it is thus possible to adjust and fix stably the perfect verticality of the door A and of its upright 10, both during retraction into the compartment B and during swing closure onto the useful internal space V of the piece of furniture M. The minimum and maximum length of the stroke of the contrast plate 54 is delimited by a pawl (not shown), which is integral with the plate 51 and can slide within a slot (55) of the contrast plate 54.

Figure 2:
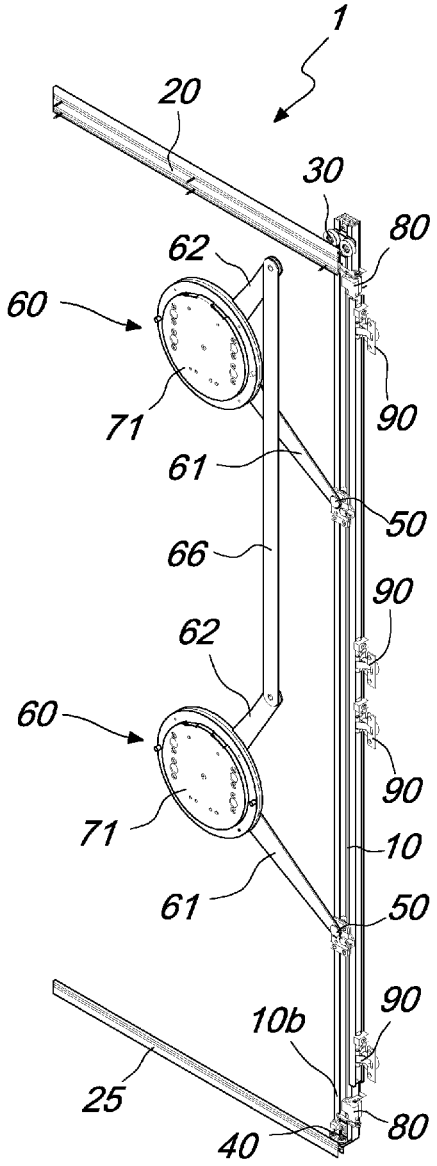
FIG. 2 is a perspective view of the same device as FIG. 1, taken from its opposite side.
Figure 3A:
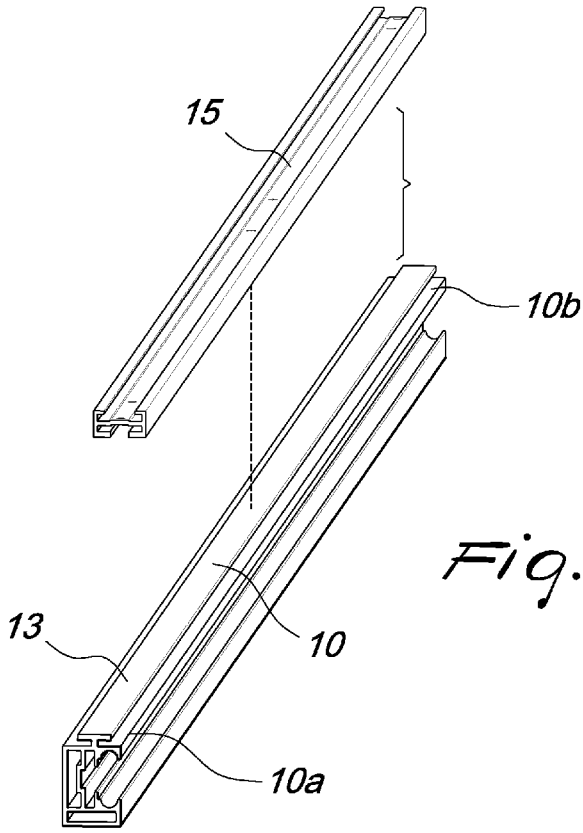
FIG. 3*a* is a perspective view of the upright and of a profile thereof, which can be associated in order to allow the hinged support of the door to the device of FIGS. 1 and 2, shown in a flat position for graphic convenience.
Figure 3B:
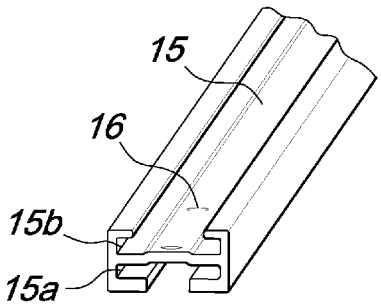
FIG. 3*b* is an enlarged partial perspective view of a detail of FIG. 3*a;*
Figure 3C:
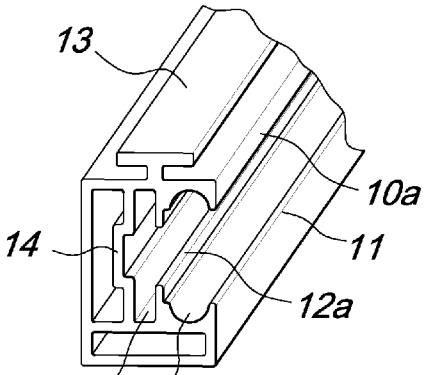
FIG. 3*c* is an enlarged partial perspective view of a detail of FIG. 3*b;*

With particular reference to FIGS. 1 and 2, a pair of rockers 60 is associated with the upright 10 by a corresponding number of carriages 50. Each rocker 60 is constituted not only by the arm 61 for oscillating connection, which can translate vertically, to the upright 10 by interposition of the respective carriage 50, but also by a second arm 62, which is rigidly connected to the other arm 61, in a position which is for example perpendicular, and is provided with its own oscillation pivot 64.

According to the solution exemplified also in FIGS. 8 and 10 and 14 to 16, the arms 61 and 62 of each rocker 60 are preferably welded or in any case stably joined to a disk 63 which is coaxial to the pivot 64 and is designed for a possible application of a device for damping the opening and closing motion of the sliding door, as specified better hereinafter.

In any case, according to the solution of the accompanying figures, the pivot 64 of both rockers 60 is associated stably with the outer surface of the shoulder of the piece of furniture that already supports the depth guides 20-25 within the retraction compartment B, allowing the oscillation of the rockers 60 by interposition, for example, of adapted bushings or bearings (not shown).

In turn, the arms 62 of the two rockers 60 are mutually joined and pivoted by means of a distribution bar 66, which ensures a synchronized oscillation thereof, with respect to the positioning and pushing or pulling motion of the upright 10 and of the door A, along the guides 20 and 25, within the retraction compartment B.

As already mentioned, the sliding door or wing A is stably associated and hinged to the upright 10 by interposition of a portion of a profile 15 which is shaped like a double letter C, as exemplified in particular in FIG. 3, and the internal compartment 15*a* of which accommodates the cross member of the profile 13 of the upright 10, after suitable adjustment and locking 16.

Figure 7:
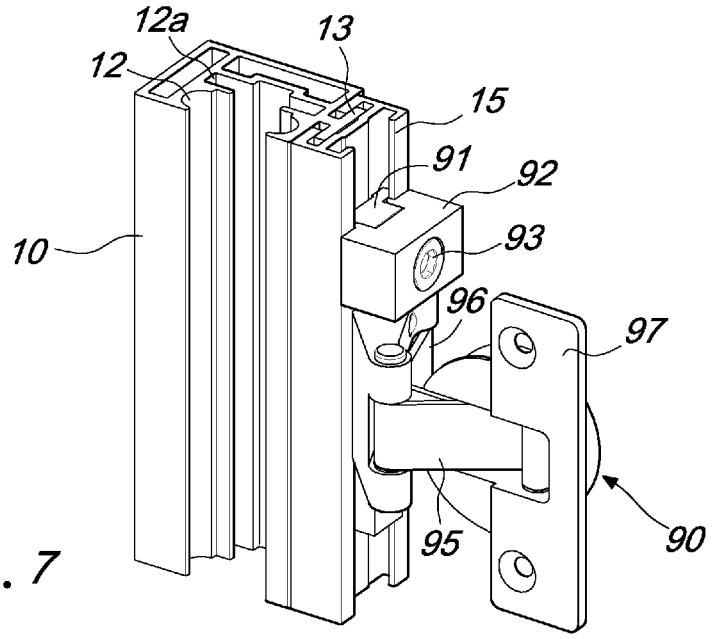
FIG. 7 is a partial enlarged-scale and detailed perspective view of the fixing of the hinges to the profile of FIG. 3.

With particular reference to FIG. 7, the outer compartment 15*b* of the portion of profile 15 is designed to accommodate the base 91 of a series of hinges 90, each of which is locked in the chosen vertical position of the profile 15, with the closure and locking of at least one block 92, by means of at least one screw 93, against the outer surface of the profile 15 which is already rendered integral with the upright 10.

Having thus described the main parts of the device being considered and their intermediate arrangement, between the shoulder of the piece of furniture and the edge of the sliding door or wing A, within the retraction compartment B of the piece of furniture M, their operation is summarized hereinafter also in relation to compliance with the specified aim and objects, with the aid in particular of FIGS. 8 to 13.

Figure 8:
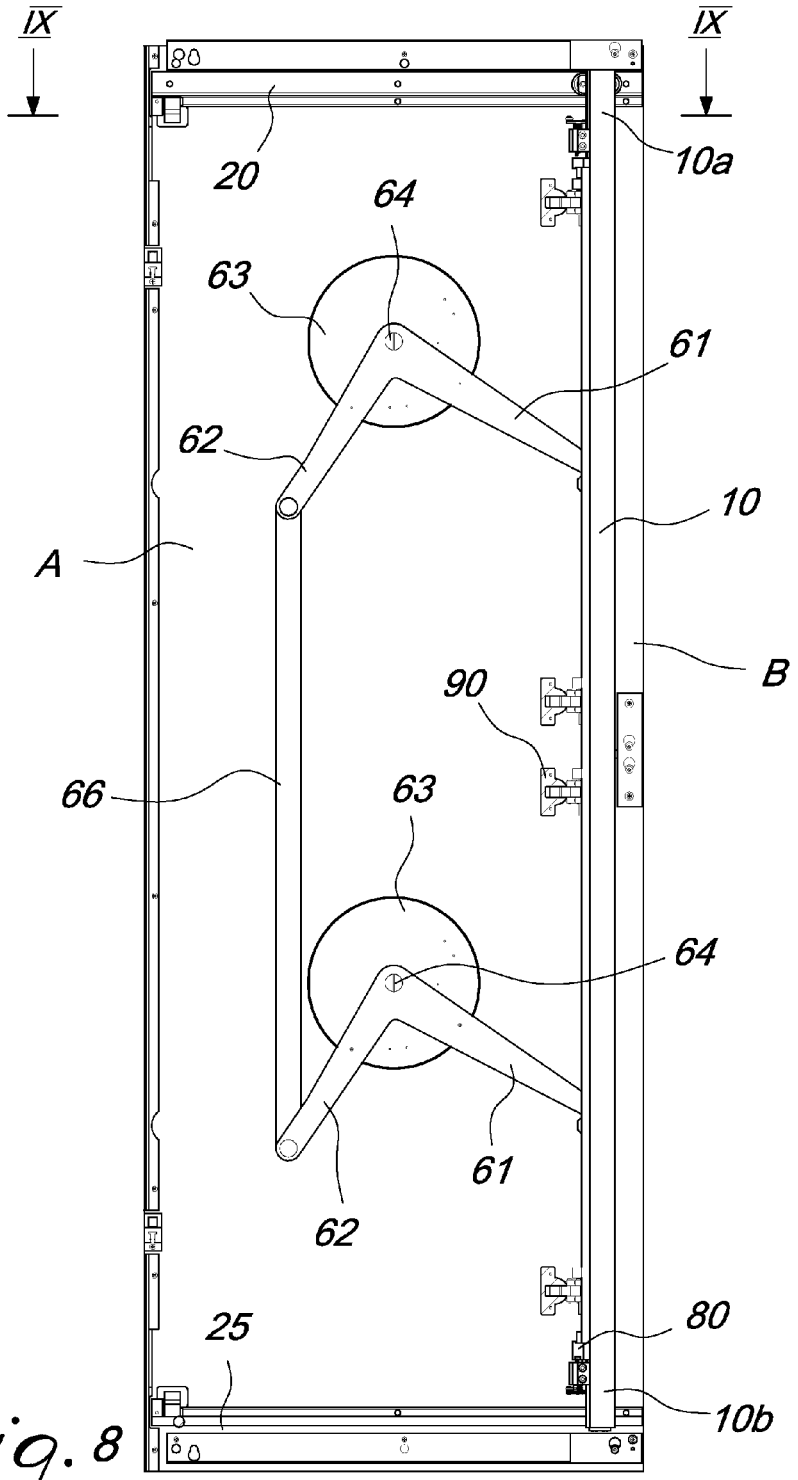
FIG. 8 is an elevation view of the device of FIGS. 1 and 2, applied to the side of a piece of furniture and associated with the edge of the door, such door being arranged in its condition of full accommodation within the retraction compartment that is adjacent to the useful internal space of the piece of furniture, the device and the door being shown along the sectional line VIII-VIII of FIG. 9.
Figure 9:
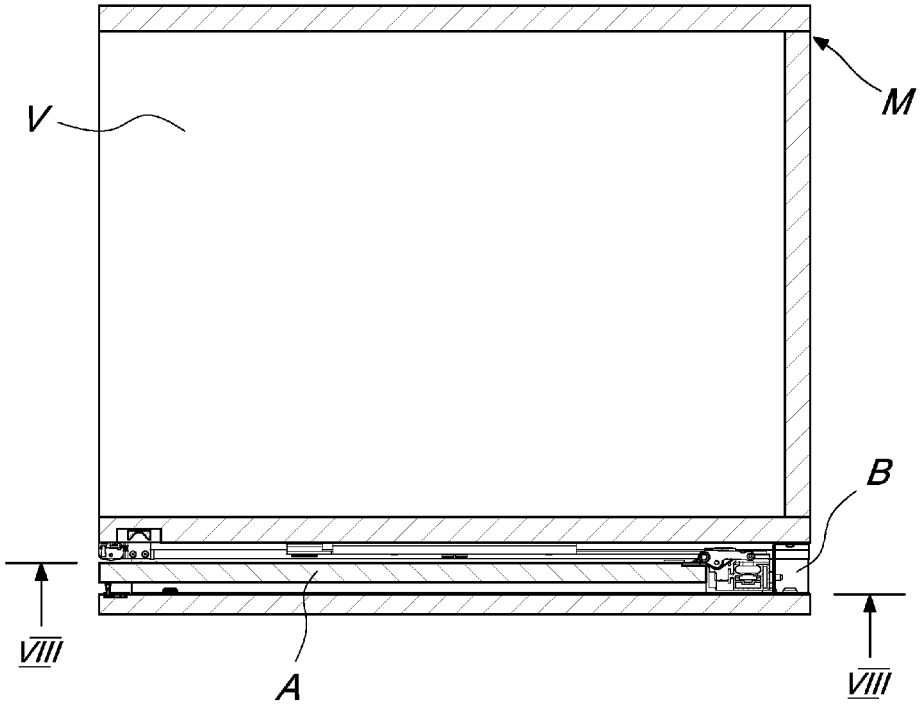
FIG. 9 is a plan view of the piece of furniture, of the retractable door and of its sliding device, taken along the sectional line IX-IX of FIG. 8.

With reference to FIGS. 8 and 9, a door A for closing the internal space V of the piece of furniture M is shown in its condition of full retraction within the compartment B of the piece of furniture M, in order to leave the useful internal space V completely open and accessible, being guided and retained therein in this condition by the device 1 being considered.

In the retraction condition, the upright 10 is accommodated at the rear end of the compartment B, supported and guided vertically by its head carriages 30-40, which slide along the respective guides 20-25 and in turn supporting the door A by means of the series of hinges 90. The stable retention of the door A in its condition of full retraction within the compartment B is ensured by the presence of the two arms 61 of the two rockers 60, which can move along the upright 10, by means of the respective carriages 50, thus having their second arms 62, joined by the bar 66, synchronized in the oscillation of the rockers 60, maintaining the verticality of the upright 10 and therefore of the door A at all times of translation and positioning.

Figure 10:
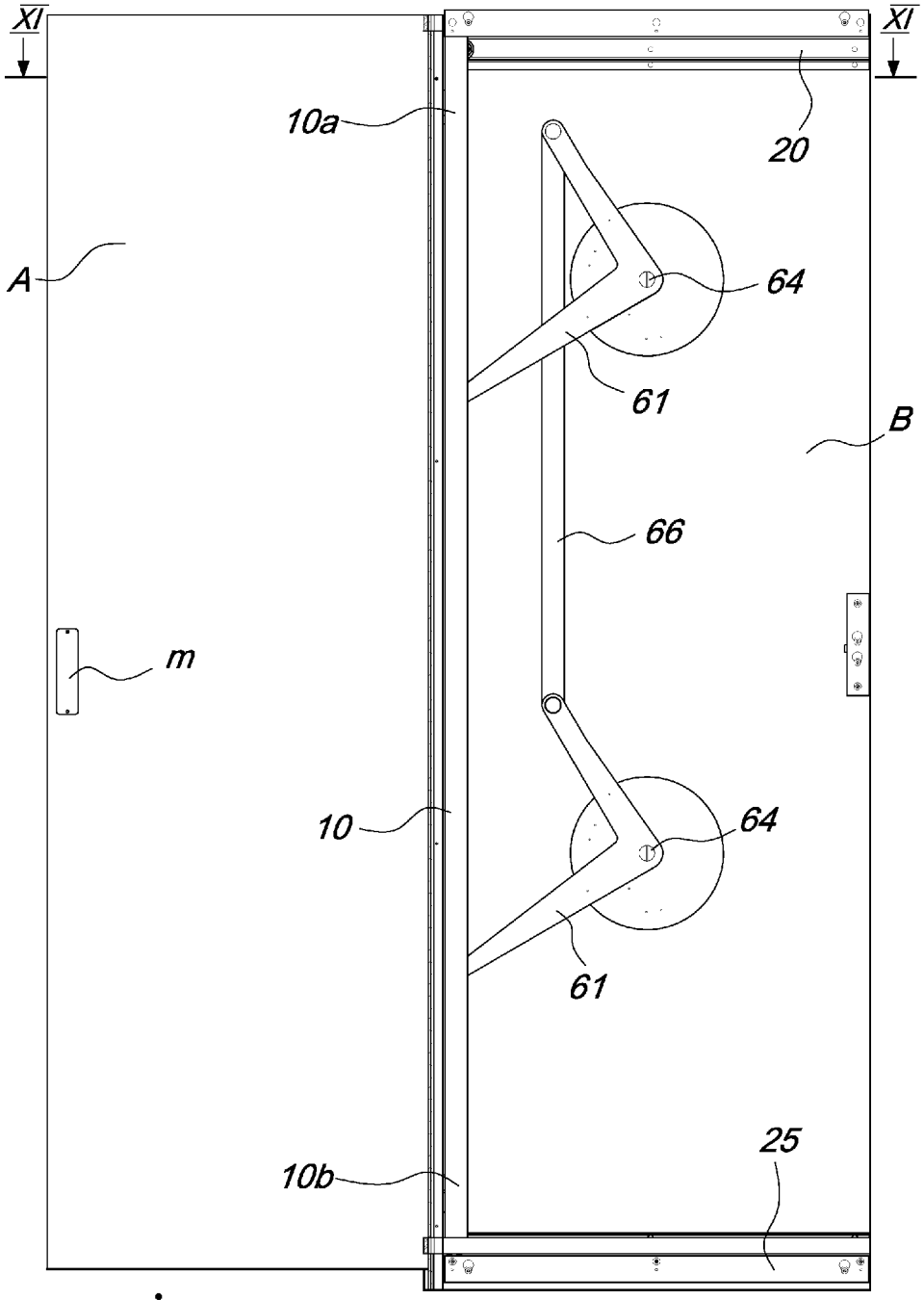
FIG. 10 is an elevation view of the device of FIGS. 1 and 2, applied on the same side of the piece of furniture of FIG. 8, the piece of furniture being shown with the door fully extracted from its retraction compartment or doing insertion, along the sectional line X-X of FIG. 11.
Figure 11:
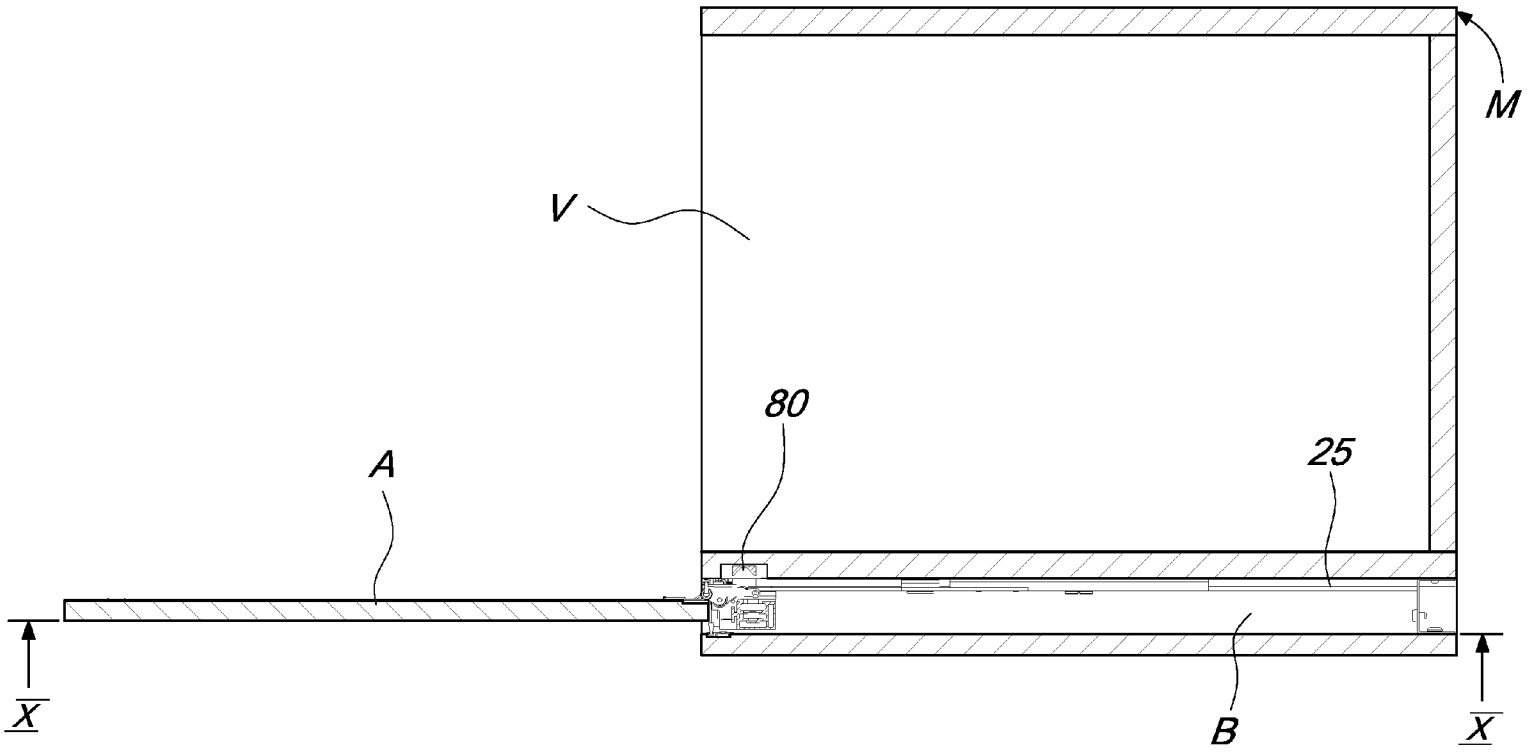
FIG. 11 is a plan view of the piece of furniture and of the device of FIG. 10, taken along its sectional line XI-XI.

With reference to FIGS. 10 and 11, as already mentioned, the moment of maximum extraction of the door A from the retraction compartment B of the piece of furniture M, for example by manual action by means of the recessed handle m, is shown. With the extraction of the door A of course there is also the simultaneous extraction of the upright 10, which by sliding along its guides 20-25 also engages the arms 61 of the two rockers 60 so as to rotate about their pivot 64. In fact, since the rockers 60 have their pivot 64 fixed integrally to the same wall that also supports the guides 20-25, the translation of the upright 10 causes the rotation of the arms 61 of the two rockers 60, such rotation being facilitated by the interposition of the carriages 50 between the ends of the arms 61 and the upright 10. By means of the carriages 50 it is still possible to render the arms 61 able to oscillate along the upright 10.

The rotation of the arms 61 of course entails the rotation also of the perpendicular arms 62 of the two respective rockers 60, such rotation being necessarily synchronized due to the presence of the distribution bar 66 which is pivoted to the arms 62.

If the bar 62 is not present in the device 1 being considered, upon an accidental obstacle while pulling the door A or upon pulling it irregularly, the two arms 61 would rotate in a manner which is not synchronized and parallel, with a variation of their distance or center distance along the upright 10, so that the same door A might be extracted in an inclined form, then maintaining a lack of verticality with respect to the piece of furniture M.

The function of the distribution bar 66 is indeed to always ensure the perfect balancing of the door A and of its upright 10, distributing on the upright 10 not only the cantilever weight of the door A, but also any irregular pulling or pushing motion of t door A moving within the compartment B.

In the constructive solution exemplified so far, the device 1, applied to the lateral shoulder of the door A, allows a better utilization of the depth of the internal space V than all the other known solutions. Due to these constructive and functional characterizations, the device 1 being considered therefore allows the application to the piece of furniture M of retracting doors A that are provided as a single panel, even of considerable size and weight, without having to render them folding so that they can be accommodated in the retraction compartment B, with simplicity and safety, in accordance with the specified aim.

The presence of the pair of rockers 60 which cooperates with the upright 10 in order to support and balance the translational motion of the door A in the retraction compartment B makes this movement extremely light and quiet, in accordance with another one of the specified objects.

Figure 12:
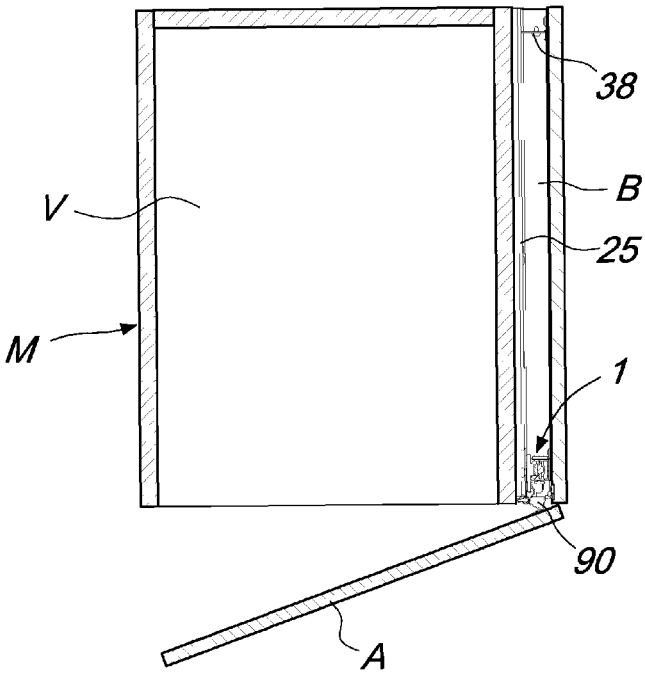
FIG. 12 is a plan view of the piece of furniture and of the device of FIG. 11, in an enlarged form and with the door already extracted from the retraction compartment, being shown in a step of partial swing closure onto the internal space of the piece of furniture.
Figure 13:
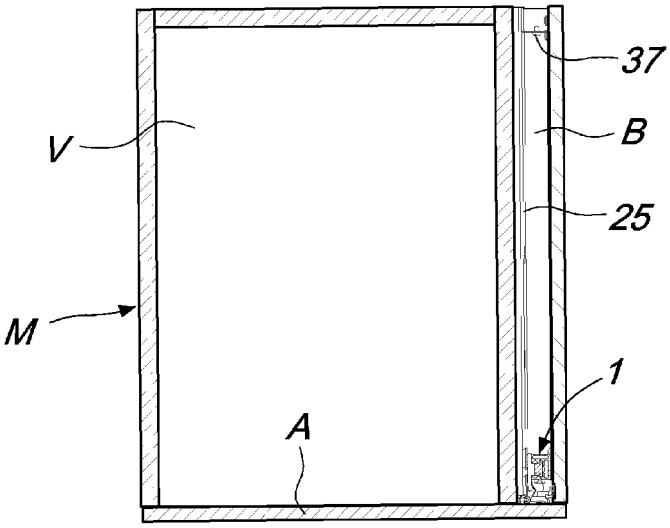
FIG. 13 is a plan view of the piece of furniture and of the device of FIG. 12, shown in the condition of complete closure of the door onto its useful internal space.

With reference to FIGS. 12 and 13, the fact becomes clear that once the step of full extraction of the door A from the retraction compartment B has ended, the carriages 30 and 40 of the upright 10 are locked at the outer limit of the guides 20-25 for the activation of the return-preventing device 80.

With the upright 10 arranged at the edge of the retraction compartment B and with the bases 91 of the hinges 90 integrally fixed to the profile 15 of the upright 10, the double pair of movable levers 95-96 of the hinges 90, i.e. their fixing base 97, protrude, with respect to the edge of the retraction compartment B, allowing the rotary motion of the door A, until any intermediate position thereof of FIG. 12 and of complete swing closure of FIG. 13 is reached.

FIGS. 12 and 13 show that the series of hinges 90 preferably applied to the piece of furniture M is of the double-lever type 95-96, with the result that when the door A is completely closed the door A can be superimposed on the shoulders of the lateral uprights of the piece of furniture M, ensuring their visual concealment, with a considerable aesthetic and visual advantage, in addition to being able to ensure the maximum extent of the useful volume of the piece of furniture M, in accordance with another one of the specified objects.

According to a first constructive variation of the present device for the application of laterally retracting doors, the device 1, instead of being applied to the outer surface of the wall of the useful internal space V, can be applied to the internal surface of the outer wall of the retraction compartment B, thus arranging on such surface the guides 20-25 and the pivot 64 of the rockers 60, in addition to the optional box 72 of the damping system cited above and described better hereinafter.

Figure 14:
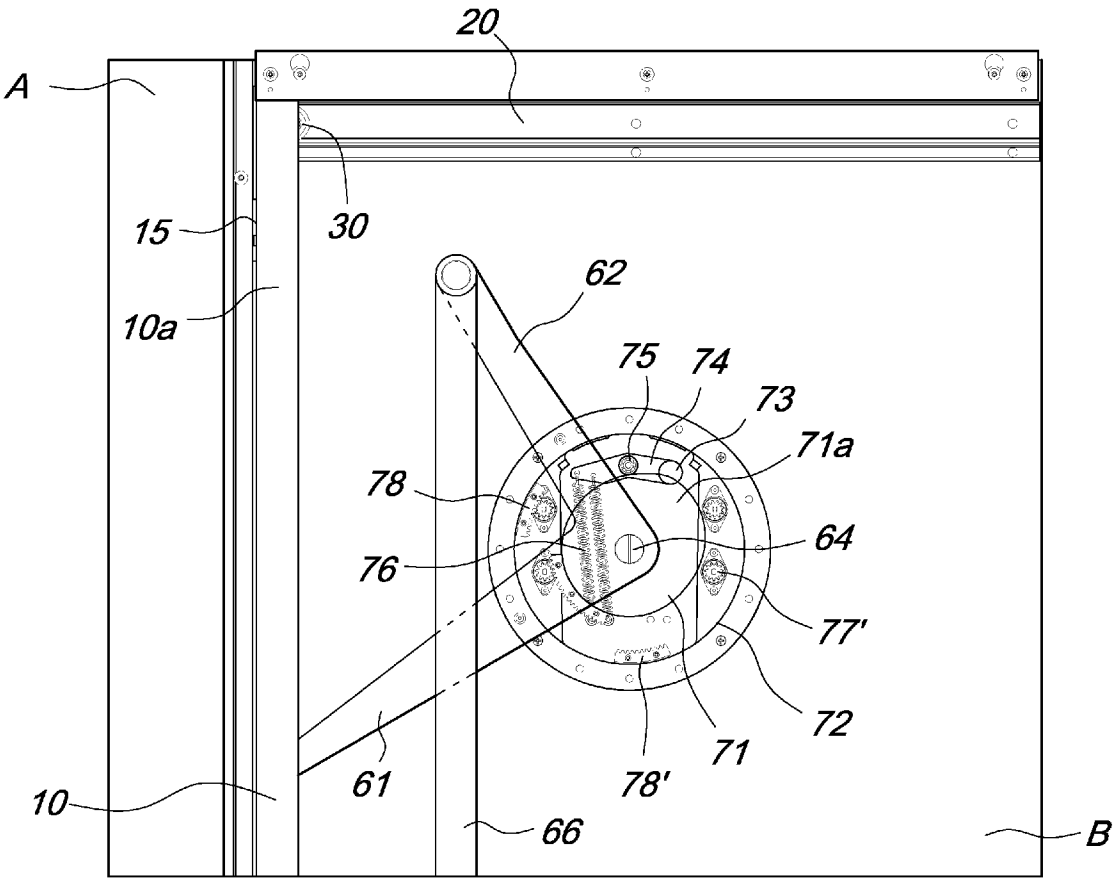
FIG. 14 is a partial enlarged-scale vertical view of the piece of furniture and of the device of FIG. 10, illustrating the possibility to apply a system for damping the sliding motion of the door, shown in the damping condition in the final step of extraction or initial step of insertion of the door in its retraction compartment.
Figure 15:
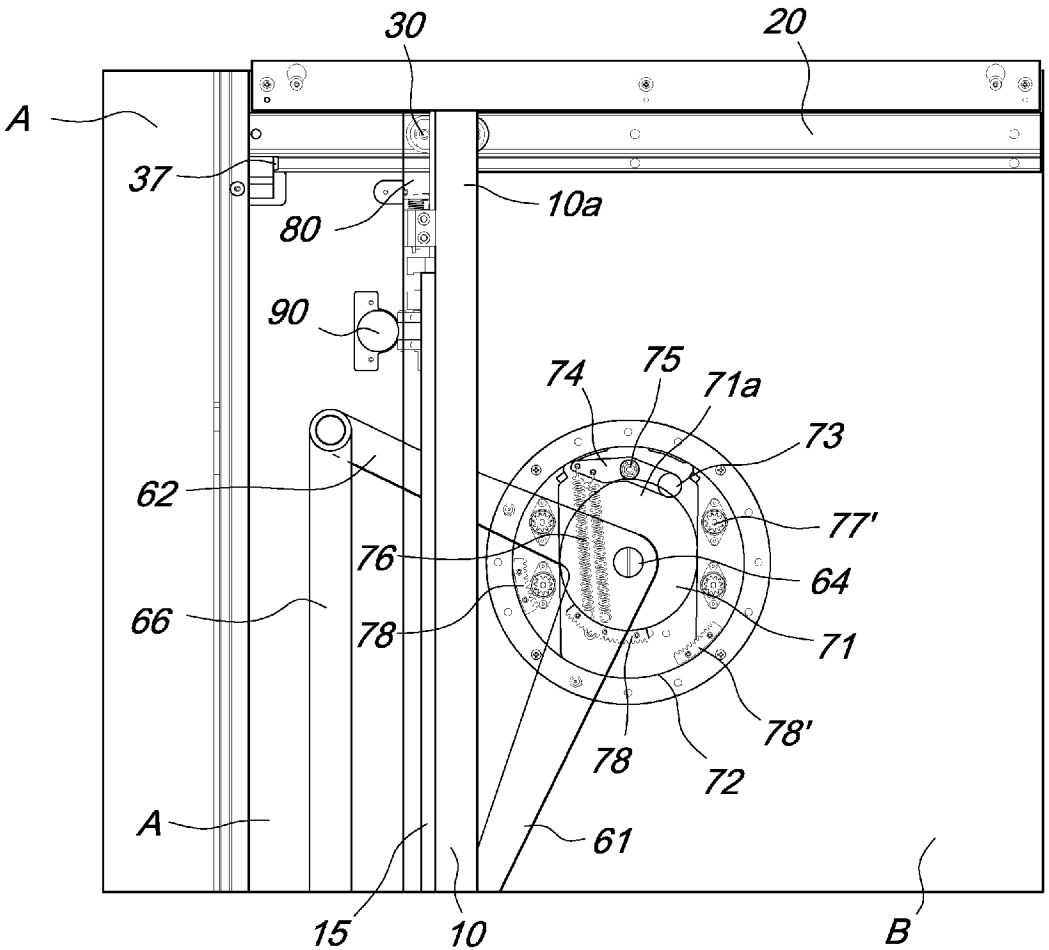
FIG. 15 is a vertical, partial and enlarged-scale view of the piece of furniture and device of FIG. 14, shown in an intermediate condition of accommodation of the door in its retraction compartment, with the damping system in the condition of maximum reaction.
Figure 16:
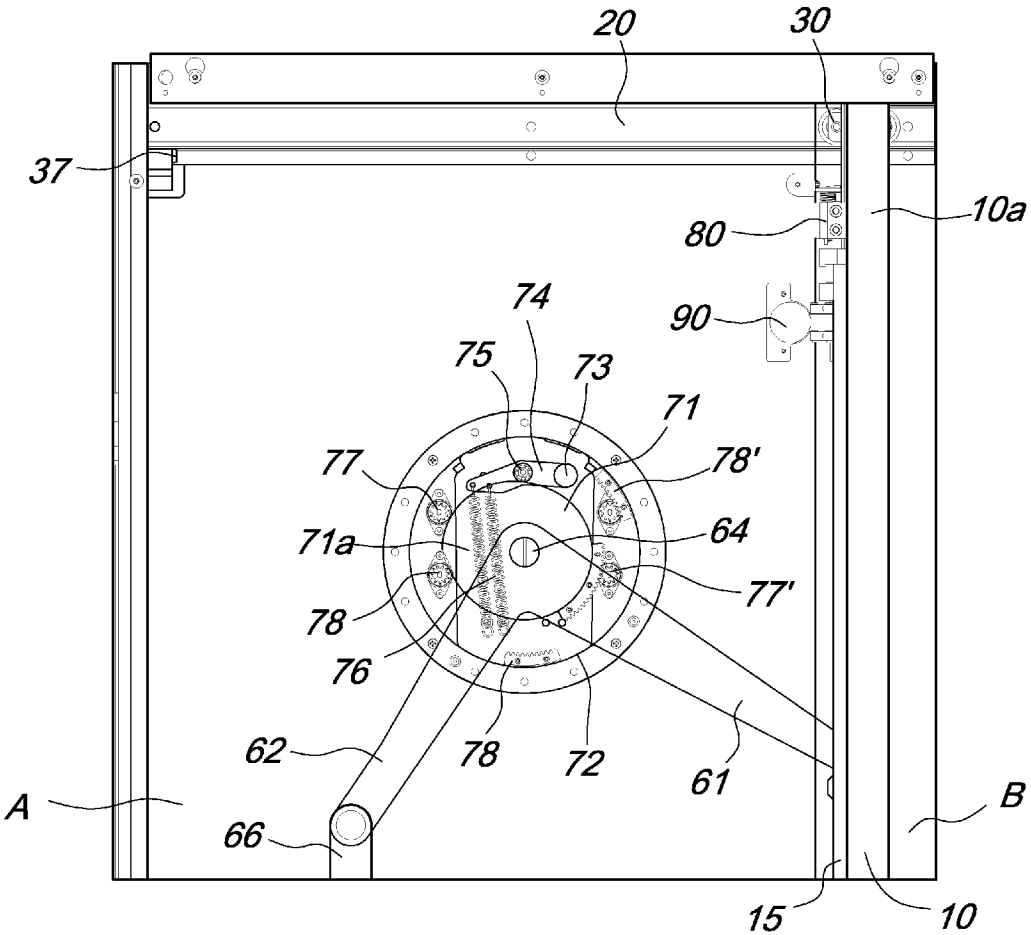
FIG. 16 is a partial and enlarged-scale vertical view of the piece of furniture and device of FIGS. 14 and 15, shown in a condition of full accommodation of the door within its retraction compartment, with the damping system shown in its final step of actuation.

With particular reference to FIGS. 14-15 and 16, as already mentioned, a partial front view in phantom lines of a preferential application of a system 70 for damping the translational motion of the door A and of its upright 10 within its retraction compartment B is illustrated.

In greater detail, also with reference to FIGS. 1 and 2, the internal side of the disk 63 of at least one rocker 60 is provided with a surface in relief 71 which is cam-shaped and is oriented conveniently with respect to the position of the arms 61-62 of the rocker 60.

The disk or cover 63 is rendered able to rotate on the raised edge of a box 72, which is fixed to the same outer surface of the useful internal space of the piece of furniture M where also the guides 20-25 are fixed and on the bottom of which the pivot 64 for the rotation of each rocker 60 is fixed.

A pivot 73 is rigidly fixed on the bottom of the box 72, and the end of an arm 74 is pivoted, such arm being provided with a probe roller 75, the opposite end being associated with the end of one or more elastic means 76 whose opposite end is integral with the bottom of the box 72. Due to the traction force of the elastic means 76, the probe 75 is constantly placed in contact with the cam-like profile 71 of the cover 63 of the rocker 60.

The base of the box 72 is also provided with a series of dampers or oil pressure-controlled braking devices 77, which act in contrast against a series of portions of circular rack 78 which are arranged in suitable grip positions.

With particular reference to FIG. 14, the condition is shown in which the upright 10 is arranged at the end of the retraction compartment B and the cam 71 of the disk or cover 63 has a surface of maximum eccentricity 71*a* which is arranged upstream of the point of contact of the probe 75 with the elastic means 76 that react to the entry of the door A in the retraction compartment B, whereas the engagement of the dampers 77 on the racks 78 is irrelevant, since they have a single direction of rotation in which they apply their dissipative function.

With reference to FIG. 15, the condition is shown in which the surface of maximum eccentricity 71*a* of the cam 71 is axially aligned with the probe 75, constituting the dead center between the step of manual pushing of the door A within the compartment B and the subsequent step in which the elastic means 76 react to push the door A into the compartment B again without the influence of the contact between the damper 77 and the racks 78.

With reference to FIG. 16, the condition is shown in which the surface of maximum eccentricity 71*a* is arranged abundantly far from the probe 75 and the pushing action of the elastic means 76 is braked by the action of the dampers 77' on the racks 78', until the abutment of the upright 10 against the stroke limiting abutments 38 within the compartment B is guided.

In order to extract the door A from the compartment B starting from the position of FIG. 16, the door A is pulled out manually, with gradual loading of the elastic means 76, due to the contact of the probe 75 with the rising part 71*a* of the eccentric element 71, the action of the dampers 77' on the racks 78' being irrelevant, until the same dead center of FIG. 15 is reached.

Once the dead center has been passed, the elastic means 76 return the accumulated effort, pushing the door A toward the outlet of the compartment B. In the final part of the exit, the thrust force of the elastic means 76 is contrasted by the action of the dampers 77 on the racks 78.

The description of FIGS. 14-15 and 16 clearly shows that the device 1 being considered also allows a positive application of a damping device in the step of entry and exit of the door A from its retraction compartment B, in order to make the retraction even easier and safer in addition to further increasing its duration over time, in accordance with another one of the specified objects.

Of course, the constructive solution of the device 1 described and illustrated so far can be changed and adapted to different conditions of use. By way of example, one wishes to indicate the possibility of joining in an upward region the two walls of the retraction compartment B by means of a plate or thin laminated element, so as to be able to have a door A that can also cover the upper edge of the internal space V, having an adequate height of the compartment B despite ensuring adequate protection of the device 1 against dust and making the entire piece of furniture M more solid.

It is furthermore possible to apply the cam 71 and the consequent damping box 72 only to one of the two rockers 60, and likewise the presence of the dampers 77 and of the ring gears 78 also can be excluded or replaced with other conventional braking systems.

It is furthermore possible to provide a different angular ratio between the arms 61 and 62 of the rockers 60, and it is likewise possible to provide for the application to the shoulder 13 of the upright 10 of a different type of profile 15 to which any type of hinge 19 among conventional ones provided with pairs of movable levers 95-96 is to be fixed.

Based on what has been described and illustrated so far, it is evident that the device 1 can also be applied to doors A that are made up of two or more wings which are mutually joined and rendered able to fold by hinges in order to be accommodated in a retraction compartment that must have an adequate width, and likewise it is possible to provide for the application of two mutually opposite retracting doors on the two sides or shoulders of a single piece of furniture.

These and other similar modifications or adaptations are in any case understood to fall within the novelty of the invention for which protection is claimed.

The disclosures in Italian Patent Application No. BL2010A000020 from which this application claims priority are incorporated herein by reference.

The invention claimed is:

1. A device for applying a laterally retracting door, particularly for a piece of furniture, at least between a side wall of a useful internal space of the piece of furniture and the door thereof, in order to be able to render the door laterally retracting during the opening of said internal space, comprising:

an upright adapted to be interposed between said side wall and an edge of the door for providing sliding and pivoting of the door;

longitudinal guides adapted to be fixed horizontally on an outer surface of said side wall, said upright having an upper end and a lower end slidably connected to said longitudinal guides such that said upright is able to slide within the depth of the piece of furniture when the device is mounted in the piece of furniture;

a pair of rockers each formed by a pair of arms which converge at a fixed angle, a first arm of said pair of arms of each one of said pair or rockers being vertically slidingly connected to said upright, second arms of said pair of arms of said pair of rockers being mutually interconnected by means of a load distribution bar; and a respective oscillation pivot, adapted to be integrally pivoted on said outer surface of said side wall, for each one of said pair of rockers, wherein the first arm of the first rocker of the pair of rockers and the first arm of the second rocker of the pair of rockers maintain a parallel relationship with one another throughout movement of the door.

2. The device according to claim 1, wherein said upright is formed by a profile.

3. The device according to claim 2, wherein the upright has an outer longitudinal groove, with a longitudinal cavity having an elongated semicircular cross-section and an inner longitudinal groove, and a lateral shoulder which is T-shaped and adapted to accommodate a longitudinal profile, on which hinges are applied for the support and pivoting of the door.

4. The device according to claim 3, wherein the upright is slidably connected along the guides by interposition respectively of an upper carriage and of a lower carriage, which are fixed respectively to said upper and lower ends of said upright.

5. The device according to claim 4, wherein said upper carriage is constituted by a plate for supporting a pair of free grooved wheels, said plate being provided with a stem with a base plate on which a pair of screws is made to pass through and is screwed onto a threaded seat of at least one contrast plate, which is accommodated in a compartment of the upper end of the upright, and is provided with shoulders which are adapted to be guided within the compartment of the same upright.

6. The device according to claim 5, wherein the upper carriage is applied to the upper guide, accommodating grooves of the grooved wheels along a rail of the upper guide, so as to render said upper carriage slidable along a compartment of said upper guide, which inhibits lateral exit of the upper carriage, in the presence also of a perpendicular upper edge of the upper guide.

7. The device according to claim 4, wherein said lower carriage is constituted by a plate supporting a pair of free rollers, said plate being provided with a substantially perpendicular stem which is arranged in the compartment of the upright and is associated, by means of at least one screw, with an external contrast plate, which is accommodated in the outer longitudinal groove of said upright, for the correct locking of the carriage at said lower end.

8. The device according to claim 7, wherein the lower carriage is applied to the lower guide, accommodating said free rollers along a guiding seat of the lower guide that allows a depth stroke of the lower carriage within a retraction compartment of the piece of furniture.

9. A device for applying a laterally retracting door, particularly for a piece of furniture, at least between a side wall of a useful internal space of the piece of furniture and the door thereof, in order to be able to render the door laterally retracting during the opening of said internal space, comprising:

an upright adapted to be interposed between said side wall and an edge of the door for providing sliding and pivoting of the door;

longitudinal guides adapted to be fixed horizontally on an outer surface of said side wall, said upright having an upper end and a lower end slidably connected to said longitudinal guides such that said upright is able to slide within the depth of the piece of furniture when the device is mounted in the piece of furniture;

a pair of rockers each formed by a pair of arms which converge at a fixed angle, a first arm of said pair of arms of each one of said pair or rockers being vertically slidingly connected to said upright, second arms of said pair of arms of said pair of rockers being mutually interconnected by means of a load distribution bar; and a respective oscillation pivot, adapted to be integrally pivoted on said outer surface of said side wall, for each one of said pair of rockers, wherein said upright is formed by a profile, wherein the upright has an outer longitudinal groove, with a longitudinal cavity having an elongated semicircular cross-section and an inner longitudinal groove, and a lateral shoulder which is T-shaped and adapted to accommodate a longitudinal profile, on which hinges are applied for the support and pivoting of the door, and wherein the longitudinal cavity of the upright accommodates a pair of annular free wheels of two carriages, which are inserted therein in an intermediate part of the upright for ensuring a dynamic connection of the upright, therefore of the door integrally hinged thereto, with said first arm of said pair of rockers.

10. The device according to claim 9, wherein each said carriage is constituted by a plate which, by means of pivots, supports a pair of free wheels, while a contrast plate is guided thereat and retained by a pair of lateral guides, with a stroke that is limited by a slot which accommodates a pin which is integral with the plate, said contrast plate being provided with a pivot that pivots and allows the oscillation of the end of said first arm of said rocker.

11. The device according to claim 10, wherein the contrast plate is provided with a threaded protrusion, in which the stem of a screw is screwed whose head is accommodated in a compartment of the base plate, so that by rotating said screw the contrast plate is forced to perform a translational motion along the guides, with consequent transverse movement of the pivot and of the end of the arm of the rocker, thus allowing adjustment for perfect verticality of the door and of the upright when the device is mounted, both during retraction into a retraction compartment of the piece of furniture and during swing closure onto the useful internal space of the piece of furniture.

12. The device according to claim 11, wherein said pair of rockers is associated with the upright by means of a corresponding number of said carriages, each rocker, being constituted by said first arm for connection, which can oscillate and perform a vertical translation with respect to the upright by the interposition of the respective carriage, and by said second arm, which is connected rigidly to the first arm, in a substantially perpendicular position, and is provided with its own said oscillation pivot, said arms of each rocker being joined stably to a disk which is coaxial with respect to their pivot and is designed for a device for damping the opening and closing motion of the sliding door.

13. The device according to claim 12, wherein the pivot of both rockers is associated stably with the same surface of the piece of furniture that already supports the depth guides within the retraction compartment, allowing the oscillation of said rockers.

14. The device according to claim 13, wherein the second arms of the two rockers are mutually joined and pivoted by means of the distribution bar, which ensures a synchronized oscillation thereof with respect to the positioning and pushing or pulling motion of the upright and of the door along the guides within the retraction compartment.

15. The device according to claim 14, wherein it is connectable to one or the other of the internal surfaces of the compartment for the retraction of the door, arranging on said surface the guides and the pivot of the rockers, in addition to a box of a damping system.

16. The device according to claim 12, wherein a cam is shaped on an internal side of the disk of at least one of the two rockers and is oriented with respect to the first and second arms, said disk being able to rotate on a raised edge of the box a base of which is fixed to the same surface that supports the guides and supports a pivot that provides a fulcrum to an arm which is provided with a probe roller, said probe roller being arranged in contact with the edge of the cam by way of elastic means, in order to facilitate the motion of extraction and insertion of the door in the retraction compartment, while dampers limit the speed of said door proximate to the points of initial and final arrival within the compartment.

17. A device for applying a laterally retracting door, particularly for a piece of furniture, at least between a side wall of a useful internal space of the piece of furniture and the door thereof, in order to be able to render the door laterally retracting during the opening of said internal space, comprising:

an upright adapted to be interposed between said side wall and an edge of the door for providing sliding and pivoting of the door;

longitudinal guides adapted to be fixed horizontally on an outer surface of said side wall, said upright having an upper end and a lower end slidably connected to said longitudinal guides such that said upright is able to slide within the depth of the piece of furniture when the device is mounted in the piece of furniture;

a pair of rockers each formed by a pair of arms which converge at a fixed angle, a first arm of said pair of arms of each one of said pair or rockers being vertically slidingly connected to said upright, second arms of said pair of arms of said pair of rockers being mutually interconnected by means of a load distribution bar; and a respective oscillation pivot, adapted to be integrally pivoted on said outer surface of said side wall, for each one of said pair of rockers, wherein the second arms of the two rockers are pivoted by means of the distribution bar, which ensures a synchronized oscillation thereof with respect to the positioning and pushing or pulling motion of the upright and of the door along the guides within the retraction compartment, and wherein the first arm of the first rocker of the pair of rockers and the first arm of the second rocker of the pair of rockers maintain a parallel relationship with one another throughout movement of the door.

* * * * *